US010138764B2

(12) United States Patent
Son et al.

(10) Patent No.: US 10,138,764 B2
(45) Date of Patent: Nov. 27, 2018

(54) CONTINUOUS VARIABLE VALVE DURATION APPARATUS AND ENGINE PROVIDED WITH THE CONTINUOUS VARIABLE VALVE DURATION APPARATUS

(71) Applicant: HYUNDAI MOTOR COMPANY, Seoul (KR)

(72) Inventors: You Sang Son, Suwon-si (KR); Kyoung Pyo Ha, Seongnam-si (KR); Back Sik Kim, Osan-si (KR)

(73) Assignee: Hyundai Motor Company, Seoul (KR)

( * ) Notice: Subject to any disclaimer, the term of this patent is extended or adjusted under 35 U.S.C. 154(b) by 189 days.

(21) Appl. No.: 15/369,285

(22) Filed: Dec. 5, 2016

(65) Prior Publication Data

US 2017/0284235 A1 Oct. 5, 2017

(30) Foreign Application Priority Data

Mar. 31, 2016 (KR) ..... 10-2016-0039493

(51) Int. Cl.
*F01L 1/34* (2006.01)
*F01L 1/22* (2006.01)
*F01M 9/10* (2006.01)

(52) U.S. Cl.
CPC ..... *F01L 1/22* (2013.01); *F01M 9/102* (2013.01); *F01M 9/109* (2013.01)

(58) Field of Classification Search
CPC ..... F01L 1/22; F01M 9/102; F01M 9/109
See application file for complete search history.

(56) References Cited

U.S. PATENT DOCUMENTS 5,924,334 A 7/1999 Hara et al.
2001/0052331 A1* 12/2001 Nakamura ..... F01L 1/34 123/90.17

FOREIGN PATENT DOCUMENTS

| | | | |
|---|---|---|---|
| EP | 2322771 | A1 | 5/2011 |
| JP | 06-185321 | A | 7/1994 |
| JP | 09-41924 | A | 2/1997 |
| JP | 4259512 | B2 | 4/2009 |
| JP | 5582195 | B2 | 9/2014 |
| KR | 10-1326818 | B1 | 11/2013 |

* cited by examiner

*Primary Examiner* — Zelalem Eshete
(74) *Attorney, Agent, or Firm* — McDermott Will & Emery LLP

(57) ABSTRACT

A continuous variable valve duration apparatus includes a camshaft, a first and second cam portion, each including a cam and a cam key, where the camshaft is inserted into the first and second cam portions and where relative phase angles with respect to the camshaft are variable, a first and second inner bracket transmitting a rotation of the camshaft to the first and second cam portions respectively, a first and second slider housing, a cam cap rotatably supporting the first and second cam portions respectively, a slider pin rotatably inserted into the first sliding hole and slidably inserted into the camshaft, a cam pin on which a cam key slot for the cam key to be slidably inserted thereinto is formed, a control shaft disposed parallel to the camshaft and engaged with the first and second slider housings, and a control portion selectively rotating the control shaft.

19 Claims, 13 Drawing Sheets

CONTINUOUS VARIABLE VALVE DURATION APPARATUS AND ENGINE PROVIDED WITH THE CONTINUOUS VARIABLE VALVE DURATION APPARATUS

CROSS-REFERENCE TO RELATED APPLICATION

This application claims the benefit of priority to Korean Patent Application No. 10-2016-0039493, filed with the Korean Intellectual Property Office on Mar. 31, 2016, the entire contents of which are incorporated herein by reference.

TECHNICAL FIELD

The present disclosure relates to a continuous variable valve duration apparatus and an engine provided with the same. More particularly, the present disclosure relates to a continuous variable valve duration apparatus and an engine provided with the same which may vary an opening duration of a valve according to operational conditions of an engine and having a simple construction.

BACKGROUND

An internal combustion engine generates power by burning fuel in a combustion chamber along with an air media drawn into the combustion chamber. Intake valves are generally operated by a camshaft in order to intake air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. That is, an optimal lift or optimal opening/closing timing of the valves depends on the rotation speed of the engine. In order to achieve such optimal valve operations depending on the rotation speed of the engine, various research, such as designing a plurality of cams and a continuous variable valve lift (CVVL) that can change valve lift according to engine speed, has been performed.

In order to achieve such an optimal valve operation depending on the rotation speed of the engine, research has been undertaken on a continuously variable valve timing (CVVT) apparatus that enables different valve timing operations depending on the engine speed. The general CVVT may change valve timing along with, or according to, a fixed valve opening duration.

However, the general CVVL and CVVT are complicated in construction and are expensive in manufacturing costs.

The above information disclosed in this Background section is only for enhancement of understanding of the background of the disclosure and therefore it may contain information that does not form the prior art that is already known in this country to a person of ordinary skill in the art.

SUMMARY

Various aspects of the present disclosure provide a continuous variable valve duration apparatus and an engine provided with the same which may vary opening durations of a valve according to operational conditions of an engine, with a simple construction.

A continuous variable valve duration apparatus according to an exemplary embodiment of the present disclosure may include a camshaft, a first and second cam portion, each including a cam and a cam key, where the camshaft is inserted into the first and second cam portions and where relative phase angles with respect to the camshaft are variable, a first and second inner bracket transmitting a rotation of the camshaft to the first and second cam portions respectively and on which a first and a second sliding hole are formed respectively, a first and second slider housing into which the first and second inner bracket are rotatably inserted, and where relative positions of the first and second slider housings with respect to the camshaft are variable, a cam cap rotatably supporting the first and second cam portions respectively and where each slider housing is slidably mounted to a cam cap, a slider pin rotatably inserted into the first sliding hole and slidably inserted into the camshaft, a cam pin on which a cam key slot for the cam key to be slidably inserted thereinto is formed and rotatably inserted into the second sliding hole, a control shaft disposed parallel to the camshaft and engaged with the first and second slider housings for selectively moving the first and second slider housings, and a control portion selectively rotating the control shaft for changing positions of the first and the second inner brackets.

The slider pin may include a pin body slidably inserted into the camshaft and a pin head rotatably inserted into the first sliding hole, wherein the pin body and the pin head may be integrally formed.

A camshaft oil hole may be formed in the camshaft along a length direction thereof, a body oil hole may be formed in the pin body and configured to communicate with the camshaft oil hole and an oil groove may be formed in the pin head and configured to communicate with the body oil hole.

A shaft hole where the control shaft is inserted into may be formed to the cam cap.

The continuous variable valve duration apparatus may further include a shaft bearing inserted into the shaft hole and rotatably supporting the control shaft.

A guide slot may be formed on the cam cap, a guide shaft inserted into the guide slot and on which a rack gear is formed thereto may be protruded from the slider housing and a pinion gear may be formed on the control shaft and engaged with the rack gear and wherein the positions of the slider housings may be changed according to rotations of the control shaft.

The continuous variable valve duration apparatus may further include a bushing inserted into the guide slot for reducing frictional forces of the movement of the guide shaft.

The continuous variable valve duration apparatus may further include a stopper disposed to the cam cap for limiting the movement of the slider housing.

The continuous variable valve duration apparatus may further include a slider housing bearing disposed between the slider housing and the first and second inner brackets respectively.

The cam may be formed as a pair, a cam cap connecting portion may be formed between the two cams of the cam portions and the cam cap may rotatably support the cam cap connecting portion.

The control portion may include a worm wheel connected to the control shaft, a worm gear engaged with the worm wheel and a control motor selectively rotating the worm gear.

The first inner bracket and the second inner bracket may be connected to each other.

An engine according to an exemplary embodiment of the present disclosure may include a camshaft, two cam portions including a first and a second cam portion, each including a cam and a cam key, where the camshaft is inserted into the first and second cam portions and where relative phase angles with respect to the camshaft are variable, a first and a second inner bracket transmitting a rotation of the camshaft to the first and second cam portions respectively and on which a first and a second sliding hole are formed respectively, a first and second slider housing into which the first and second inner brackets are rotatably inserted, and where relative positions of the first and second slider housings with respect to the camshaft are variable, a cam cap rotatably supporting the first and second cam portions respectively and where each slider housing is slidably mounted to a cam cap, a slider pin rotatably inserted into the first sliding hole and slidably inserted into the camshaft, a cam pin on which a cam key slot for the cam key to be slidably inserted thereinto is formed and rotatably inserted into the second sliding hole, a control shaft disposed parallel to the camshaft and engaged with the first and second slider housings for selectively moving the first and second slider housings, and a control portion selectively rotating the control shaft for changing positions of the first and the second inner brackets.

The slider pin may include a pin body slidably inserted into the camshaft and a pin head rotatably inserted into the first sliding hole, wherein the pin body and the pin head may be integrally formed.

A camshaft oil hole may be formed in the camshaft along a length direction thereof, a body oil hole may be formed in the pin body and configured to communicate with the camshaft oil hole and an oil groove may be formed in the pin head and configured to communicate with the body oil hole.

A shaft hole where the control shaft is inserted into may be formed on the cam cap, the cam may be formed as a pair, a cam cap connecting portion may be formed between the two cams of the cam portions and each cam portion may be rotatable between the cam cap and the cylinder housing.

A guide slot may be formed on the cam cap, a guide shaft inserted into the guide slot and to which a rack gear is formed may be protruded from the slider housing and a pinion gear may be formed on the control shaft and engaged with the rack gear and wherein the positions of the slider housings may be changed according to rotations of the control shaft.

A guide surface may be formed on the first and second slider housing and a guider may be formed on the cylinder head for contacting the guide surface and guiding movements of the first and second slider housing.

The first inner bracket and the second inner bracket may be connected to each other.

As described above, a continuous variable valve duration apparatus according to exemplary embodiments of the present disclosure may vary an opening duration of a valve according to operation conditions of an engine, and further may have a simple construction.

The continuous variable valve duration apparatus according to exemplary embodiments of the present disclosure may be reduced in size and thus the entire height of a valve train may be reduced.

Since the continuous variable valve duration apparatus may be applied to an existing engine without excessive modification, productivity may be enhance and production costs may be reduced.

DETAILED DESCRIPTION

Figure 1:
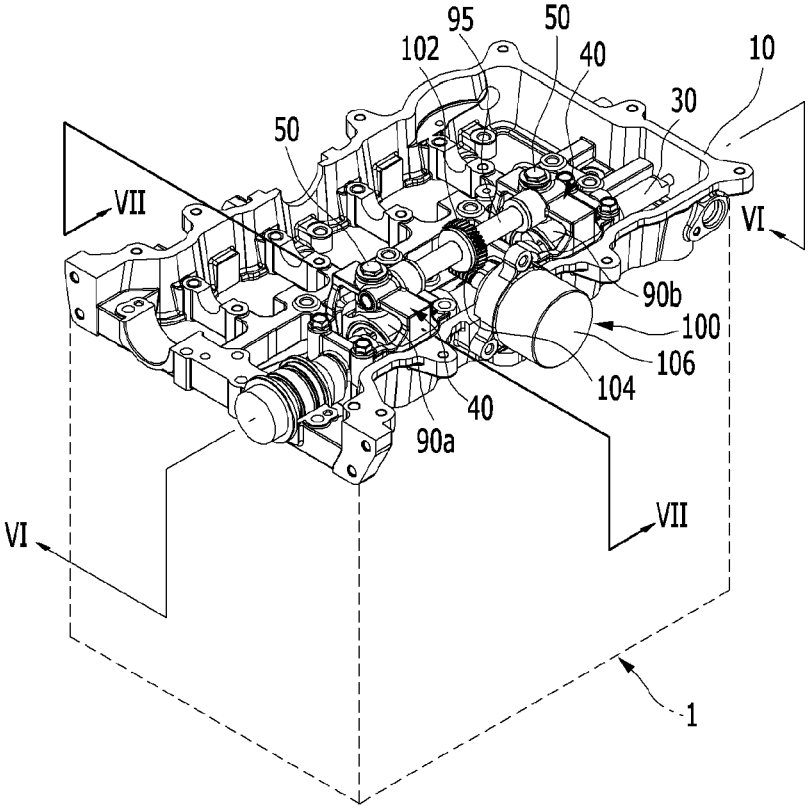
FIG. 1 is a perspective view of an engine provided with a continuous variable valve duration apparatus according to exemplary embodiments of the present disclosure.

In the following detailed description, only certain exemplary embodiments of the present disclosure have been shown and described, simply by way of illustration.

As those skilled in the art would realize, the described embodiments may be modified in various different ways, all without departing from the spirit or scope of the present disclosure A part irrelevant to the description will be omitted to clearly describe the present disclosure, and the same or similar elements will be designated by the same reference numerals throughout the specification.

In the drawings, the thickness of layers, films, panels, regions, etc., may be exaggerated for clarity.

Throughout the specification and the claims, unless explicitly described to the contrary, the word "comprise" and variations such as "comprises" or "comprising" will be understood to imply the inclusion of stated elements but not the exclusion of any other elements.

Exemplary embodiments of the present disclosure will hereinafter be described in detail with reference to the accompanying drawings.

Figure 2:
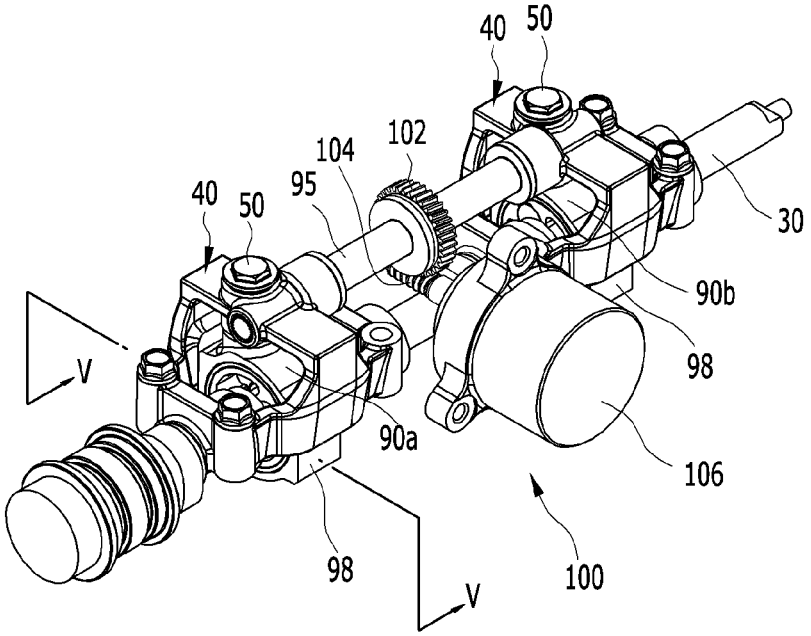
FIG. 2 is a perspective view of a continuous variable valve duration apparatus according to exemplary embodiments of the present disclosure.

FIG. 1 is a perspective view of an engine provided with a continuous variable valve duration apparatus according to exemplary embodiments of the present disclosure and FIG. 2 is a perspective view of a continuous variable valve duration apparatus according to exemplary embodiments of the present disclosure.

Figure 3:
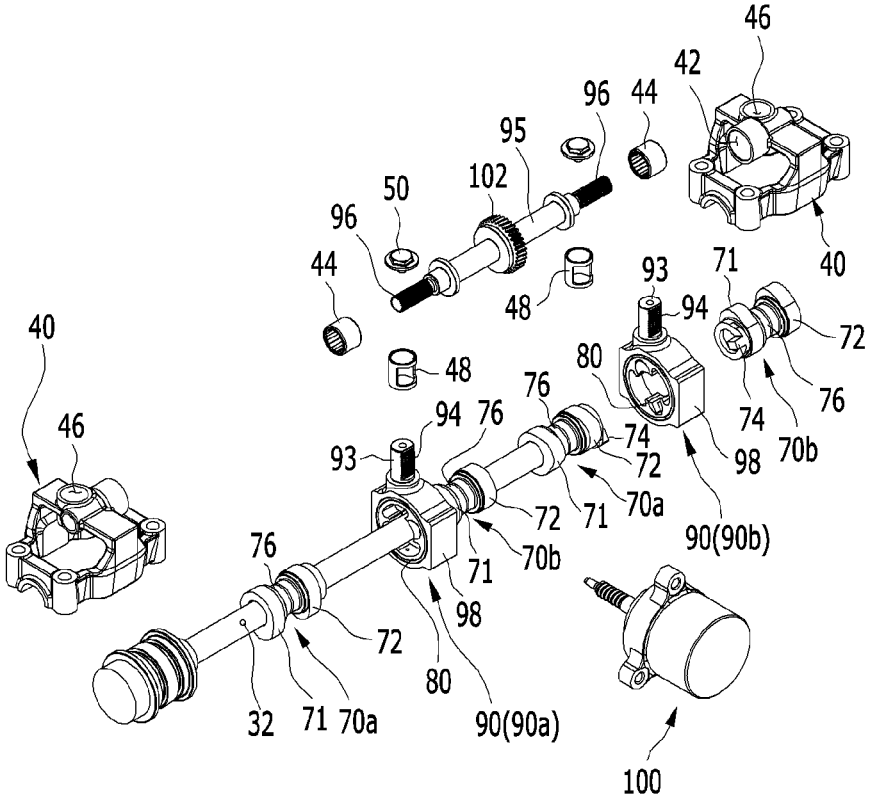
FIG. 3 and FIG. 4 are exploded perspective views of a continuous variable valve duration apparatus according to exemplary embodiments of the present disclosure.
Figure 4:
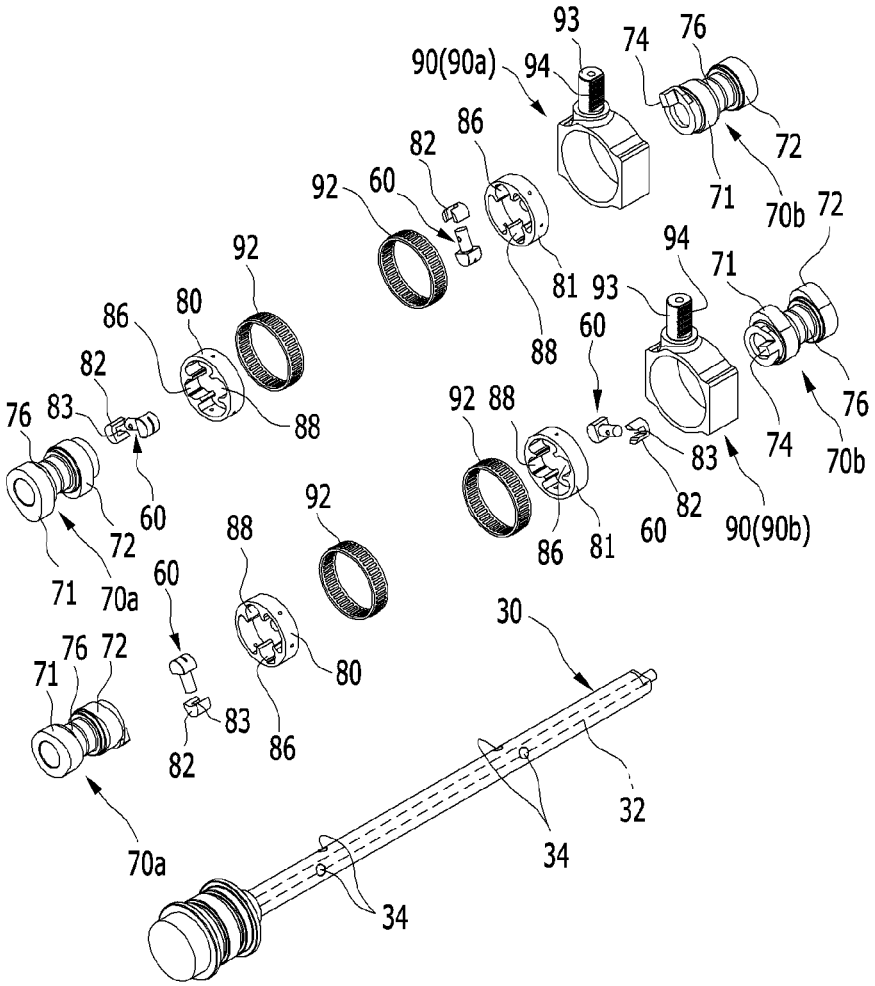

FIG. 3 and FIG. 4 are exploded perspective views of a continuous variable valve duration apparatus according to exemplary embodiments of the present disclosure.

Figure 5:
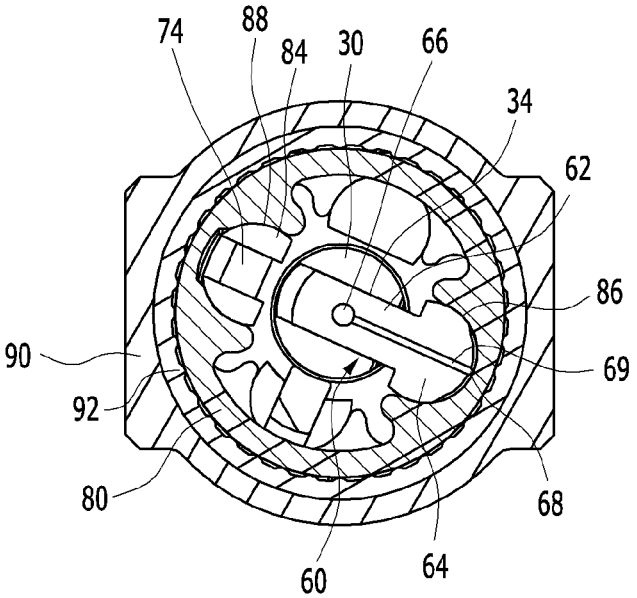
FIG. 5 is a cross-sectional view along line V-V of FIG. 2.
Figure 6:
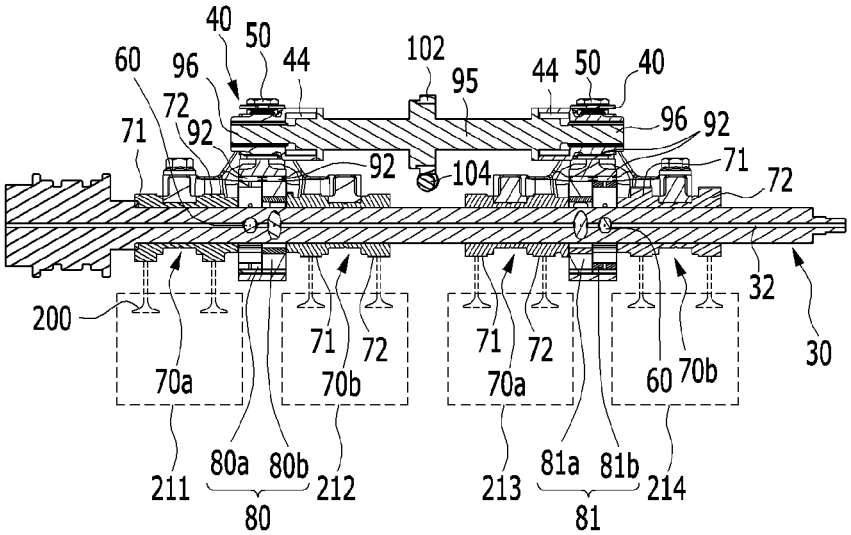
FIG. 6 is a cross-sectional view along line VI-VI of FIG. 1.
Figure 7:
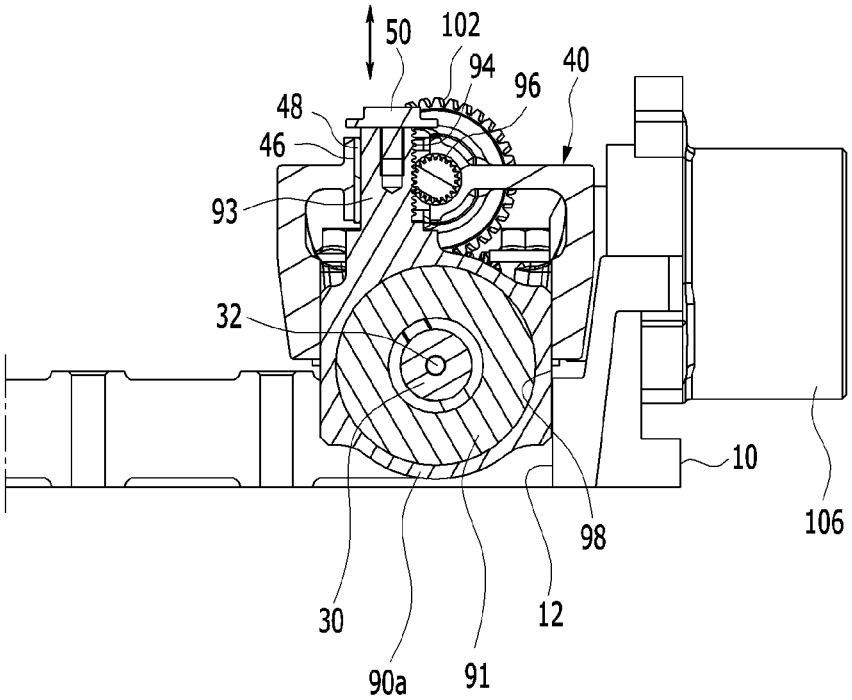
FIG. 7 is a cross-sectional view along line of VII-VII FIG. 1.

FIG. 5 is a cross-sectional view along line V-V of FIG. 2, FIG. 6 is a cross-sectional view along line VI-VI of FIG. 1 and FIG. 7 is a cross-sectional view along line VII-VII of FIG. 1.

Referring to FIG. 1 to FIG. 7, an engine 1 according to exemplary embodiments of the present disclosure includes a continuous variable valve duration apparatus and the continuous variable valve duration apparatus is mounted to the engine 1 through a cylinder head or a cam carrier 10.

In the drawings, the engine includes 4 cylinders 201, 202, 203 and 204, but is not limited thereto.

The continuous variable valve duration apparatus includes a camshaft 30, a first and second cam portion **70*a*** and 70*b* on which a cam 71 or 72 is formed respectively, on which a cam key 74 is formed, of which the camshaft 30 is inserted thereto and of which relative phase angles with respect to the camshaft 30 are variable. The continuous variable valve duration apparatus also includes a first and second inner bracket 80 and 81 transmitting rotations of the camshaft 30 to the first and second cam portion 70*a* and 70*b* respectively and on which a first and a second sliding hole 86 and 88 are formed respectively. The continuous variable valve duration apparatus also includes a first and second slider housing 90*a* and 90*b* of which the first and second inner bracket 80 and 81 are rotatably inserted thereto and of which relative position with respect to the camshaft 30 are variable, a cam cap 40 rotatably supporting the first and second cam portion 70*a* and 70*b* respectively and of which each slider housing 90 is slidably mounted thereto, a slider pin 60 rotatably inserted into the first sliding hole 86 and slidably inserted into the camshaft 30 and a cam pin 82 of which a cam key slot 83 for the cam key 74 to be slidably inserted thereto is formed and rotatably inserted into the second sliding hole 88. The continuous variable valve duration apparatus also includes a control shaft 95 disposed parallel to the camshaft 30 and engaged with the first and second slider housing 90*a* and 90*b* for selectively moving the first and second slider housing 90*a* and 90*b* and a control portion 100 selectively rotating the control shaft 95 for changing positions of the first and the second inner brackets 80*a* and 80*b*.

The camshaft 30 may be an intake camshaft or an exhaust camshaft.

In the drawings, the cam 71 and 72, for driving valves 200, is formed as a pair, but such an arrangement is not limited thereto.

Regarding, the cam portions 70*a* and 70*b*, a cam cap connecting portion 76 for engaged with the cam cap 40 is formed between the first and the second cams 71 and 72. The cylinder head 10 and the cam cap 40 are connected with each other and the cam cap connecting portion 76 is rotatably disposed between the cam cap 40 and the cylinder head 10.

The cam 71 and 72 rotate and open the valve 200.

The slider pin 60 includes a pin body 62 slidably inserted into the camshaft 30 and a pin head 64 rotatably inserted into the first sliding hole 86, wherein the pin body 62 and the pin head 64 may be integrally formed.

A camshaft hole 34 is formed to the camshaft 30, the pin body 62 of the slider pin 60 is slidably inserted into the camshaft hole 34 and the pin head 64 is rotatably inserted into the first sliding hole 86.

A camshaft oil hole 32 is formed in the camshaft 30 along a length direction thereof, a body oil hole 66 formed in the pin body 62 and configured to communicate with the camshaft oil hole 32 and an oil groove 68 is formed in the pin head 64 and configured to communicate with the body oil hole 66 through a communication hole 69 formed within the slider pin 60.

Lubricant supplied to the camshaft oil hole 32 may be smoothly supplied to the inner bracket 80 through the body oil hole 66, the communication hole 69 and the oil groove 68.

In the case that the engine includes four cylinders 201, 202, 203 and 204, the slider housing 90 may be disposed in a pair (90*a* and 90*b*) and a slider housing bearing 92 may be disposed between each first and second slider housing 90*a* and 90*b* and the first and the second inner bracket 80 and 81 respectively. Thus, rotations of the inner brackets 80 and 81 may be easily performed. In the drawings, the slider housing bearing 92 is depicted as a needle bearing, however the disclosure is not limited thereto. On the contrary, various bearings such as a ball bearing, a roller bearing and so on may be applied thereto.

A shaft hole 42 into which the control shaft 95 is inserted is formed on the cam cap 40 and a shaft bearing 44 is inserted into the shaft hole 42 and rotatably supports the control shaft 95.

A guide slot 46 is formed to the cam cap 40 and a guide shaft 93 inserted into the guide slot 46 and of which a rack gear 94 is formed thereto is protruded from the slider housings 90*a* and 90*b*.

A pinion gear 96 is formed to, or on or connected to, the control shaft 95 and engaged with the rack gear 94 and the positions of the slider housings 90*a* and 90*b* are changed according to rotation of the control shaft 95.

A bushing 48 is inserted into the guide slot 46 for reducing frictional forces of the movement of the guide shaft 93.

A stopper 50 is disposed to the cam cap 40 for limiting the movement of the slider housings 90*a* and 90*b*.

The control portion 100 includes a worm wheel 102 connected to the control shaft 95, a worm gear 104 engaged with the worm wheel 102 and a control motor 106 for selectively rotating the worm gear 104.

A guide surface 98 is formed to the first and second slider housing 90*a* and 90*b* and a guider 12 is formed to the cylinder head 10 for contacting the guide surface 98 and guiding movements of the first and second slider housing 90*a* and 90*b*.

For example, an engine with first, second, third and fourth cylinders 211, 212, 213 and 214 may be provided with two first cam portions 70*a*, two second cam portions 70*b*, two first inner brackets 80, two second inner brackets 81, two slider housings 90*a* and 90*b* and one control motor 106 and perform changing duration of each cam 71 and 72.

Figure 8:
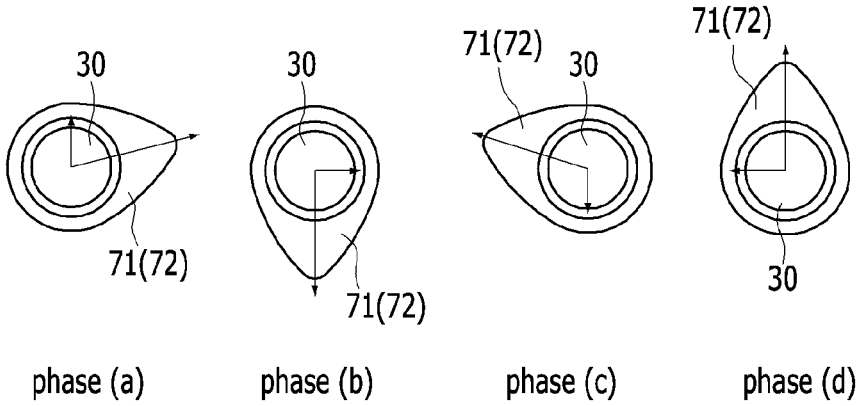
FIG. 8 and FIG. 9 are drawings showing mechanical motions of cams of a continuous variable valve duration apparatus according to exemplary embodiments of the present disclosure.
Figure 9:
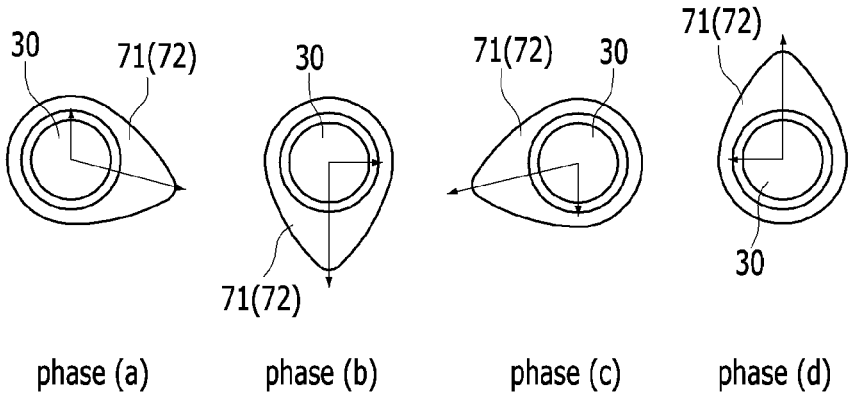

FIG. 8 and FIG. 9 are drawings showing mechanical motions of cams of a continuous variable valve duration apparatus according to exemplary embodiments of the present disclosure.

As shown in FIG. 1 to FIG. 9, according to engine operation states, an ECU (engine control unit or electric control unit or engine controller) transmits control signals to the control motor 106 of the control portion 100 to change the relative position of the first and second slider housings 90*a* and 90*b* upward or downward.

When the slider housings 90*a* and 90*b* and the inner brackets 80 and 81 move according to operations of the control motor 106, rotational centers of the inner brackets 80 and 81 with respect to the camshaft 30 are changed.

While the slider pin 60 is rotated together with the camshaft 30, the pin body 62 is slidable within the camshaft hole 34, the pin head 64 is rotatable within the first sliding hole 86, the cam pin 84 is rotatable within the second sliding hole 88 and the cam key 74 is slidable within the cam key slot 83. Thus, the relative rotation speed of the cams 71 and 73 with respect to the rotation speed of the camshaft 30 is changed.

As shown in FIG. 8, while the phase angle of the camshaft 30 is constantly changed when the relative rotation center of the cams 71 and 72 with respect to the rotation center of the camshaft 30 is changed downward, the rotation speed of the cams 71 and 72 is relatively faster than rotation speed of the camshaft 30 from phase a to phase b and from phase b to phase c, then the rotation speed of the cams 71 and 72 is relatively slower than rotation speed of the camshaft 30 from phase c to phase d and from phase d to phase a. That is, the valve duration is changed according to the various rotational speeds of the cams 71 and 71 at the corresponding phases.

As shown in FIG. 9, while the phase angle of the camshaft 30 is constantly changed when the relative rotation center of the cams 71 and 72 with respect to the rotation center of the camshaft 30 is changed upward, the rotation speed of the cams 71 and 72 is relatively slower than rotation speed of the camshaft 30 from phase a to phase b and from phase b to phase c, then the rotation speed of the cams 71 and 72 is relatively faster than rotation speed of the camshaft 30 from phase c to phase d and from phase d to phase a. That is, the valve duration is changed according to the various rotational speeds of the cams 71 and 71 at the corresponding phases.

Figure 10:
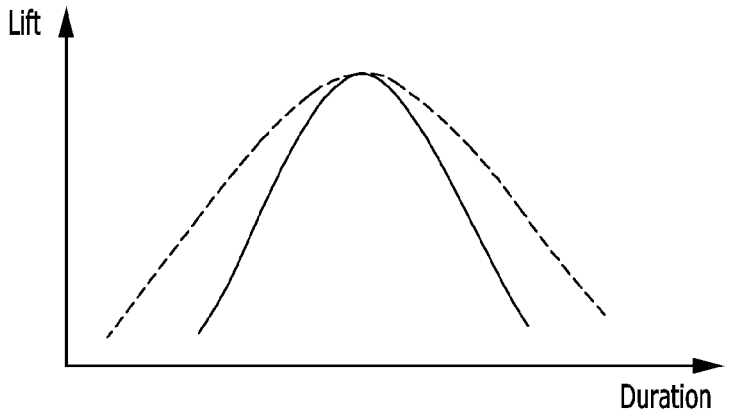
FIG. 10 and FIG. 11 are graphs of a valve profile of a continuous variable valve duration apparatus according to exemplary embodiments of the present disclosure.
Figure 11:
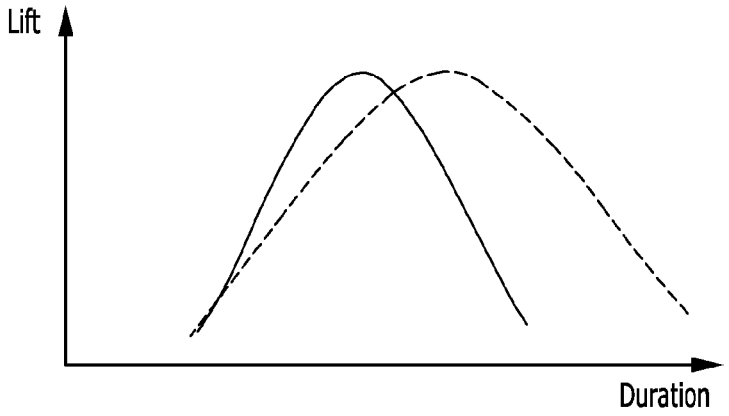

FIG. 10 and FIG. 11 are graphs of a valve profile of a continuous variable valve duration apparatus according to exemplary embodiments of the present disclosure.

As shown in FIG. 10 and FIG. 11, although maximum lift of the valve 200 is constant, a rotation speed of the cam 71 and 72 with respect to the rotation speed of the camshaft 30 is changed according to relative positions of the slider housings 90*a* and 90*b* so that closing and opening times of the valve 200 are changed. That is, a duration of the valve 200 opening is changed.

According to adjusting mounting angles of the valve 200, forming the guide surface 98 and the guider 12 and so on, a valve duration may be increased by advancing opening timing and retarding closing timing of the valve 200 as shown in FIG. 9. Or, valve duration may be shortened by retarding opening timing and advancing closing timing of the valve 200.

Also, as shown in FIG. 11, opening timing of the valve 200 may be constant and closing timing of the valve 200 may be retarded or advanced as requested.

Also, closing timing of the valve 200 may be constant and opening timing of the valve 200 may be retarded or advanced as requested.

Figure 12:
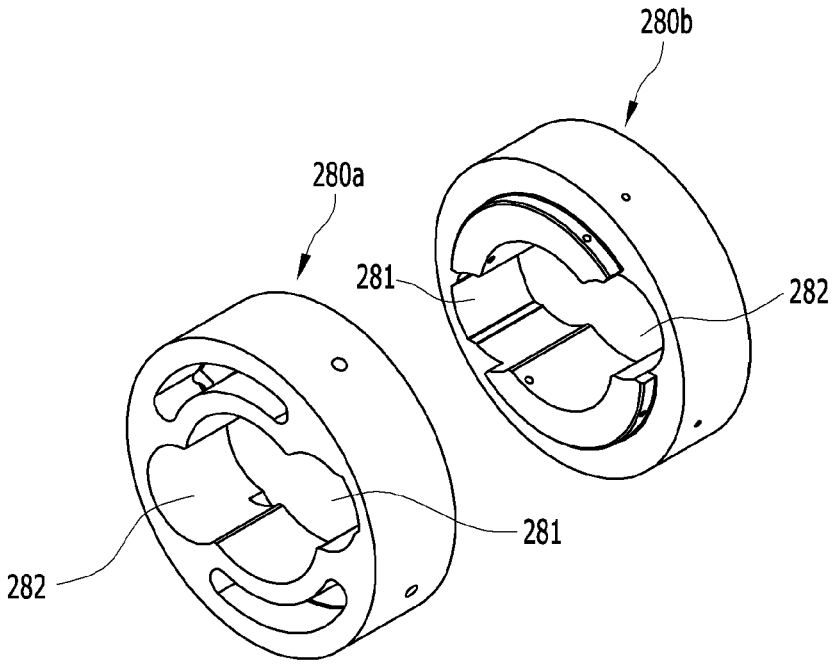
FIG. 12 and FIG. 13 are drawings showing an inner bracket according to a modified exemplary embodiment of the present disclosure.
Figure 13:
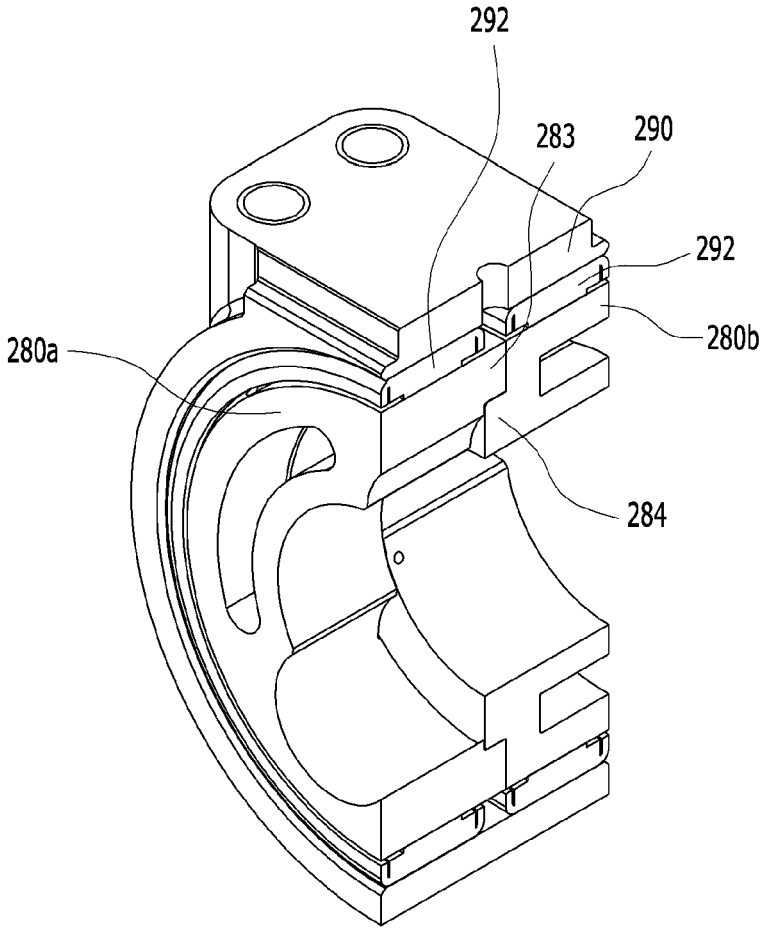

FIG. 12 and FIG. 13 are drawings showing an inner bracket according to a modified exemplary embodiment of the present disclosure.

Referring to FIG. 12 and FIG. 13, a bearing 292, for example a double row bearing may be disposed within a slider housing 290 and a first inner bracket 280*a* and a second inner bracket 280*b* may be connected to each other. For example, a first inner bracket connector 283 and a second inner bracket connector 284 are formed to the first inner bracket 280*a* and the second inner bracket 280*b* respectively, and the first inner bracket connector 283 and second inner bracket connector 284 are connected.

In the drawings, the first inner bracket connector 283 and the second inner bracket connector 284 are formed as convex shape and concave shape respectively, but configurations are not limited thereto.

In the case that the first inner bracket 280*a* and the second inner bracket 280*b* are connected, looseness or vibrations due to manufacturing tolerances of the bearing, the inner bracket, the lifter and so on may be reduced.

As described above, a continuous variable valve duration apparatus according to exemplary embodiments of the present disclosure may vary an opening duration of a valve according to operational conditions of an engine, with a simple construction.

The continuous variable valve duration apparatus according to exemplary embodiments of the present disclosure may be reduced in size and thus the entire height of a valve train may be reduced.

The continuous variable valve duration apparatus according to exemplary embodiments of the present disclosure may be reduced in size and thus the entire height of a valve train may be reduced.

Since the body oil hole 66 and the oil groove 68 are formed to the slider pin 60, lubricant may be smoothly supplied to rotating elements such as the inner brackets and so on.

While this disclosure has been described in connection with what is presently considered to be practical exemplary embodiments, it is to be understood that the disclosure is not limited to the disclosed embodiments. On the contrary, it is intended to cover various modifications and equivalents included within the spirit and scope of the appended claims.

What is claimed is:

1. A continuous variable valve duration apparatus comprising:

a camshaft;

a first and second cam portion, each including a cam and a cam key, where the camshaft is inserted into the first and second cam portions and where relative phase angles with respect to the camshaft are variable;

a first and second inner bracket transmitting a rotation of the camshaft to the first and second cam portions respectively and on which a first and a second sliding hole are formed respectively;

a first and second slider housing into which the first and second inner bracket are rotatably inserted, and where relative positions of the first and second slider housings with respect to the camshaft are variable;

a cam cap rotatably supporting the first and second cam portions respectively and where each slider housing is slidably mounted to a cam cap;

a slider pin rotatably inserted into the first sliding hole and slidably inserted into the camshaft;

a cam pin on which a cam key slot for the cam key to be slidably inserted thereinto is formed and rotatably inserted into the second sliding hole;

a control shaft disposed parallel to the camshaft and engaged with the first and second slider housings for selectively moving the first and second slider housings; and a control portion selectively rotating the control shaft for changing positions of the first and the second inner brackets.

2. The continuous variable valve duration apparatus of claim 1, wherein the slider pin comprises:

a pin body slidably inserted into the camshaft; and a pin head rotatably inserted into the first sliding hole, wherein the pin body and the pin head are integrally formed.

3. The continuous variable valve duration apparatus of claim 2, wherein:

a camshaft oil hole is formed in the camshaft along a length direction thereof, a body oil hole is formed in the pin body and configured to communicate with the camshaft oil hole and an oil groove is formed in the pin head and configured to communicate with the body oil hole.

4. The continuous variable valve duration apparatus of claim 1, wherein a shaft hole where the control shaft is inserted into is formed on the cam cap.

5. The continuous variable valve duration apparatus of claim 4, further comprising a shaft bearing inserted into the shaft hole and rotatably supporting the control shaft.

6. The continuous variable valve duration apparatus of claim 1, wherein:

a guide slot is formed on the cam cap;

a guide shaft inserted into the guide slot and of which a rack gear is formed thereon is protruded from the slider housing; and a pinion gear is formed on the control shaft and engaged with the rack gear; and wherein the positions of the slider housings are changed according to rotations of the control shaft.

7. The continuous variable valve duration apparatus of claim 6, further comprising a bushing inserted into the guide slot for reducing frictional forces of the movement of the guide shaft.

8. The continuous variable valve duration apparatus of claim 6, further comprising a stopper disposed on the cam cap for limiting the movement of the slider housing.

9. The continuous variable valve duration apparatus of claim 1, further comprising a slider housing bearing disposed between the slider housing and the first and second inner brackets respectively.

10. The continuous variable valve duration apparatus of claim 1, wherein:

the cam is formed as a pair;

a cam cap connecting portion is formed between the two cams of the cam portions; and the cam cap rotatably supports the cam cap connecting portion.

11. The continuous variable valve duration apparatus of claim 1, wherein the control portion comprises:

a worm wheel connected to the control shaft;

a worm gear engaged with the worm wheel; and a control motor selectively rotating the worm gear.

12. The continuous variable valve duration apparatus of claim 1, wherein the first inner bracket and the second inner bracket are connected to each other.

13. An engine comprising:

a camshaft;

two cam portions including a first and a second cam portion, each including a cam and a cam key, where the camshaft is inserted into the first and second cam portions and where relative phase angles with respect to the camshaft are variable;

a first and a second inner bracket transmitting a rotation of the camshaft to the first and second cam portions respectively and on which a first and a second sliding hole are formed respectively;

a first and second slider housing into which the first and second inner brackets are rotatably inserted, and where relative positions of the first and second slider housings with respect to the camshaft are variable;

a cam cap rotatably supporting the first and second cam portions respectively and where each slider housing is slidably mounted to a cam cap;

a slider pin rotatably inserted into the first sliding hole and slidably inserted into the camshaft;

a cam pin on which a cam key slot for the cam key to be slidably inserted thereinto is formed and rotatably inserted into the second sliding hole;

a control shaft disposed parallel to the camshaft and engaged with the first and second slider housings for selectively moving the first and second slider housings; and a control portion selectively rotating the control shaft for changing positions of the first and the second inner brackets.

14. The engine of claim 13, wherein the slider pin comprises:

a pin body slidably inserted into the camshaft; and a pin head rotatably inserted into the first sliding hole, wherein the pin body and the pin head are integrally formed.

15. The engine of claim 14, wherein:

a camshaft oil hole is formed in the camshaft along a length direction thereof, a body oil hole is formed in the pin body and configured to communicate with the camshaft oil hole, and an oil groove is formed in the pin head and configured to communicate with the body oil hole.

16. The engine of claim 13, wherein:

a shaft hole where the control shaft is inserted into is formed to the cam cap;

the cam is formed as a pair;

a cam cap connecting portion is formed between the two cams of the cam portions; and each cam portion is rotatable between the cam cap and the cylinder housing.

17. The engine of claim 13, wherein:

a guide slot is formed on the cam cap;

a guide shaft inserted into the guide slot and, a rack gear formed on the guide shaft is protruded from the slider housing; and a pinion gear is formed on the control shaft and engaged with the rack gear; and wherein the positions of the slider housings are changed according to rotations of the control shaft.

18. The engine of claim 13, wherein:

a guide surface is formed on the first and second slider housings; and a guider is formed to the cylinder head for contacting the guide surface and guiding movements of the first and second slider housings.

19. The engine of claim 13, wherein the first inner bracket and the second inner bracket are connected to each other.

* * * * *